US011573511B2

(12) United States Patent
Arata et al.

(10) Patent No.: US 11,573,511 B2
(45) Date of Patent: Feb. 7, 2023

(54) IMAGE FORMING APPARATUS

(71) Applicant: KYOCERA Document Solutions Inc., Osaka (JP)

(72) Inventors: Tatsuro Arata, Osaka (JP); Satoshi Ando, Saka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/542,930

(22) Filed: Dec. 6, 2021

(65) Prior Publication Data

US 2022/0179340 A1 Jun. 9, 2022

(30) Foreign Application Priority Data

Dec. 7, 2020 (JP) ..... JP2020-202898

(51) Int. Cl.
*G03G 15/20* (2006.01)

(52) U.S. Cl.
CPC ..... *G03G 15/2039* (2013.01)

(58) Field of Classification Search
CPC ..... G03G 15/2039
See application file for complete search history.

(56) References Cited

U.S. PATENT DOCUMENTS

2015/0277317 A1* 10/2015 Okabayashi ..... G03G 15/50 399/68
2020/0233349 A1* 7/2020 Takano ..... G03G 15/2042
2020/0379382 A1* 12/2020 Takeuchi ..... G03G 15/2042

FOREIGN PATENT DOCUMENTS

JP 2010-274437 A 12/2010
JP 2016-013638 A 1/2016

* cited by examiner

*Primary Examiner* — Clayton E. LaBalle
*Assistant Examiner* — Michael A Harrison
(74) *Attorney, Agent, or Firm* — Studebaker & Brackett PC

(57) ABSTRACT

An image forming apparatus includes an image forming part, a fixing device, a fixing temperature sensor, a drive device, a printed sheet number counting part, a fixing voltage power supply, a controller, and an apparatus external temperature sensor. The controller can perform a cooling mode in which, when a number of continuous printed sheets at a reference speed exceeds an upper limit number, a number of printed sheets per unit time is gradually decreased to suppress an increase of an apparatus internal temperature. The controller sets the upper limit number based on a temperature difference between the fixing temperature detected by the fixing temperature sensor and the apparatus external temperature detected by the apparatus external temperature sensor.

9 Claims, 9 Drawing Sheets

IMAGE FORMING APPARATUS

INCORPORATION BY REFERENCE

This application is based on and claims the benefit of priority from Japanese patent application No. 2020-202898 filed on Dec. 7, 2020, which is incorporated by reference in its entirety.

BACKGROUND

The present disclosure relates to an image forming apparatus, such as a copying machine and a printer, provided with a fixing device which fixes a toner image transferred on a recording medium, and particularly, a method for suppressing a temperature increase in the apparatus without adding a member.

In a conventional electrophotographic type image forming apparatus, an exposure device irradiates laser light on an image carrier, such as a photosensitive drum, which has been uniformly charged by a charge device to form a predetermined electrostatic latent image whose charge is partially attenuated, a development device supplies a toner to the electrostatic latent image to form a toner image, a transfer means transfers the toner image on a sheet (recording medium), and then a fixing device heats and pressurizes the unfixed toner to form a permanent image.

In the meantime, if the apparatus internal temperature of the image forming apparatus becomes high due to heat radiation from the fixing device, there is a possibility that an operation failure of the image forming apparatus occurs. Conventionally, the apparatus internal temperature is detected, and the printing operation is stopped or the apparatus is cooled by a cooling fan according to the detection result to suppress an increase of the apparatus internal temperature.

For example, a printing apparatus is disclosed, which includes: a power supply switching means for switching on or off the power supply of the apparatus main body; a thermal head provided with a heating element and performing printing on a recording medium based on an energization of the heating element; an elapsed time counting means for counting a count value according to a lapse of time from a point of time when a printing was performed by the thermal head the last time regardless of whether the power supply of the apparatus main body is on or off; and a print permitting means for permitting the printing by the next thermal head when the count value counted by the elapsed time counting means reaches a predetermined value.

Also a printed matter forming apparatus is disclosed, which is configured to obtain one unit print data to be printed on a tape to be printed, to control a thermal head and a conveyance roller in cooperation with each other so that a plurality of unit print images corresponding to the obtained unit print data are formed repeatedly along a conveyance direction at a printing speed synchronized with a conveyance speed, to input a printed matter forming instruction signal for instructing the forming of printed matter, to change the printing speed according to an environmental temperature in which the apparatus is installed, a printing rate in one unit print data, and a length of one printed matter to be formed, thereby avoiding a temperature increase of the thermal head and avoiding performing a cooling operation.

Both the above methods are described for a thermal printing type image forming apparatus using a thermal head, and the temperature increase of the thermal head is avoided by providing a printing stop time or reducing a printing speed. However, in consideration of a usability of a user, it is necessary to avoid the stop of printing and the reduction of the printing speed within a range where the apparatus does not fail, and to ensure as high productivity as possible.

SUMMARY

In accordance with an aspect of the present disclosure, an image forming apparatus includes an image forming part, a fixing device, a fixing temperature sensor, a drive device, a printed sheet number counting part, a fixing voltage power supply, and a controller. The image forming part forms a toner image on a recording medium. The fixing device is disposed on a downstream side of the image forming part in a conveyance direction of the recording medium, and includes a fixing member including a heated rotating body heated by a heating device and a pressing member coming into contact with the heated rotating body to form a fixing nip area. The fixing device heats and pressurizes the recording medium passing through the fixing nip area to fix the toner image on the recording medium. The fixing temperature sensor detects a fixing temperature that is a surface temperature of the heated rotating body. The drive device drives a conveyance member for conveying the recording medium. The conveyance member includes the fixing member. The printed sheet number counting part accumulates and counts a number of printed sheets. The fixing voltage power source applies a voltage to the heating device. The controller controls the drive device and the fixing voltage power source. The image forming apparatus further includes an apparatus external temperature sensor which detects an apparatus external temperature that is a temperature of an outside of the image forming apparatus is further provided. The controller can perform a cooling mode in which, when a number of continuous printed sheets at a reference speed exceeds an upper limit number, a number of printed sheets per unit time is gradually decreased to suppress an increase of an apparatus internal temperature that is a temperature of an inside of the image forming apparatus. The controller sets the upper limit number based on a temperature difference between the fixing temperature detected by the fixing temperature sensor and the apparatus external temperature detected by the apparatus external temperature sensor.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
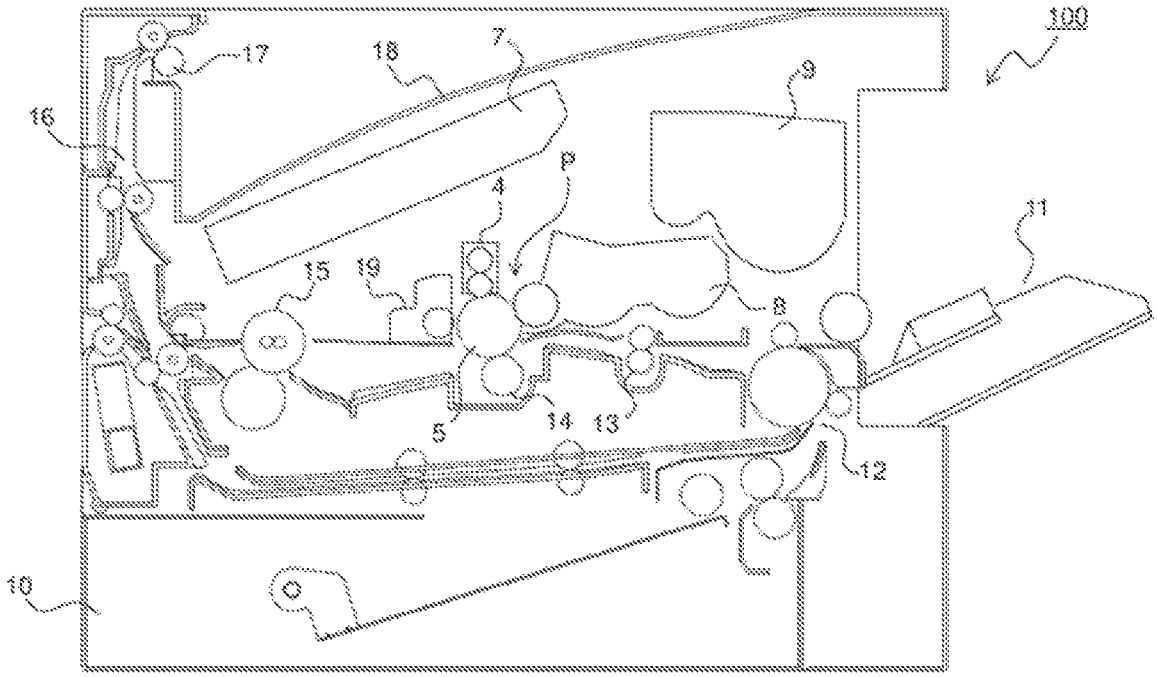
FIG. 1 is a side sectional view showing an image forming apparatus 100 according to one embodiment of the present disclosure.

Hereinafter, with reference to the attached drawings, one embodiment of the present disclosure will be described. FIG. 1 is a side sectional view showing an image forming apparatus 100 according to the embodiment of the present disclosure. The image forming apparatus (for example, a monochrome printer) 100 includes an image forming part P which forms a monochrome image by a charge process, an exposure process, a development process and a transfer process. In the image forming part P, a charge device 4, an exposure device (a laser scanning unit and the others) 7, a development device 8, a transfer roller 14 and a cleaning device 19 are disposed along a rotational direction of a photosensitive drum 5 (the clockwise direction in FIG. 1).

When an image forming operation is performed, the surface of the photosensitive drum 5 rotating in the clockwise direction by a main motor (see FIG. 3) is uniformly charged by the charge device 4. Then, an electrostatic latent image is formed on the photosensitive drum 5 by laser beam emitted from the exposure device 7 based on document image data, and a developer (hereinafter referred to as a toner) is supplied to the electrostatic latent image by the development device 8 to form a toner image. The toner is supplied to the development device 8 from a toner container 9. The image data is transmitted from a personal computer (not shown) or the like. Further, on the downstream side of the cleaning device 19 in the rotational direction of the photosensitive drum 5, a static eliminator (not shown) for removing the residual charge on the surface of the photosensitive drum 5 is provided.

A sheet (a recording medium) is conveyed toward the photosensitive drum 5 on which the toner image is formed from a sheet feeding cassette 10 or a manual sheet feeding tray 11 via a sheet conveyance path 12 and a pair of registration rollers 13, and the toner image formed on the surface of the photosensitive drum 5 is transferred to the sheet by the transfer roller 14 (an image transfer part). The sheet on which the toner image has been transferred is separated from the photosensitive drum 5, is conveyed to a fixing device 15, and the toner image is fixed. The sheet passed through the fixing device 15 is conveyed to the upper portion of the image forming apparatus 100 along a sheet conveying path 16, and is discharged on a discharge tray 18 by a pair of discharge rollers 17.

Figure 2:
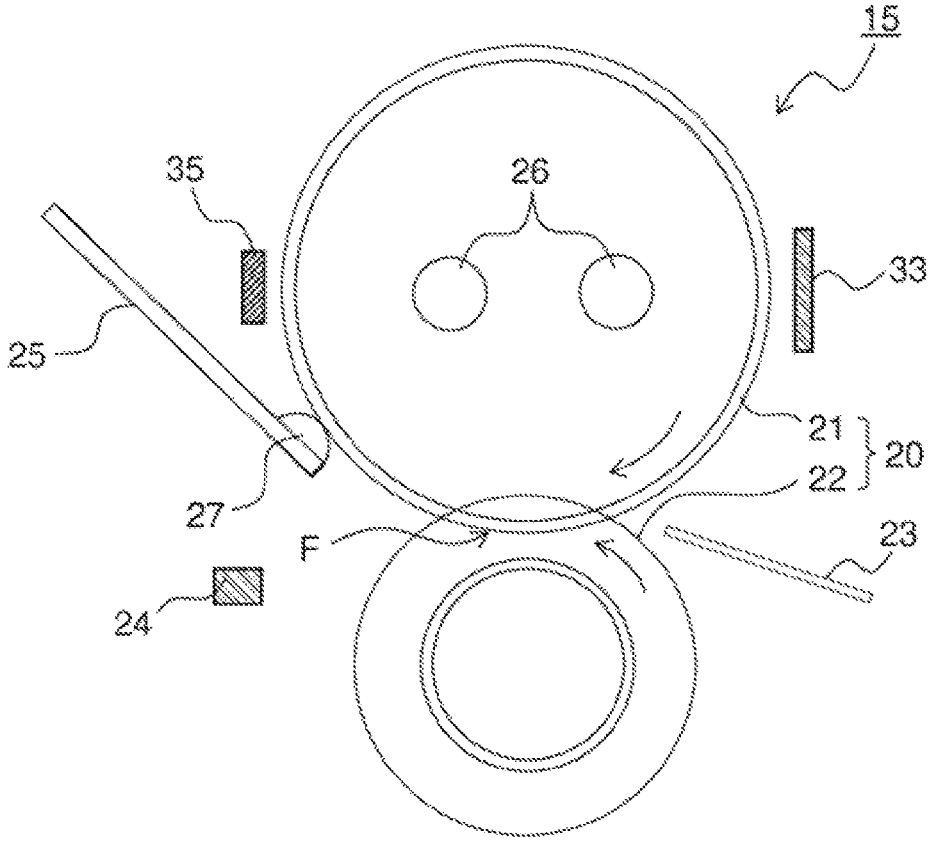
FIG. 2 is a side sectional view showing a fixing device 15 installed in the image forming apparatus 100.

FIG. 2 is a side sectional view showing the fixing device 15 installed in the image forming apparatus 100 in FIG. 1. The fixing device 15 includes a pair of fixing rollers 20, a fixing introduction guide 23, a sheet detection sensor 24, a separation plate 25 and a fixing temperature sensor 33. In FIG. 2, a housing of the fixing device 15 is not shown.

The pair of fixing rollers 20 (an example of a fixing member) includes a fixing roller 21 (an example of a heated rotating body) rotating in the clockwise direction in FIG. 2 by a fixing drive motor (see FIG. 3, an example of a drive device) and a pressing roller 22 (an example of a pressing member) driven by the fixing roller and rotating in the counterclockwise direction. The pressing roller 22 comes into pressure contact with the fixing roller 21 by a biasing means (not shown) to form a fixing nip area F between the pressing roller 22 and the fixing roller 21. When the sheet passes through the fixing nip area N, the unfixed toner on the sheet is fixed to the sheet.

The fixing roller 21 used in this embodiment has a structure in which, for example, a cylindrical aluminum core having a diameter of 30 mm, a thickness of 0.6 mm, and a crown amount (a diameter difference between the axial center portion and both the axial end portions) of 0.1 mm, on which a coating layer (a release layer) of a PFA resin (tetrafluoroethylene-perfluoroalkyl vinyl ether copolymer) is laminated. The pressing roller 22 may have a structure in which a silicone rubber layer (an elastic layer) is laminated on an aluminum core and covered with a PFA tube (a release layer).

A heater 26 (an example of a heating device) is built in the fixing roller 21. Although a halogen heater is used as the heater 26 in this embodiment, instead of the halogen heater, an IH heater having an induction heating part having an excitation coil and a core may be used to heat the fixing roller 21 from the outside.

On the upstream side of the fixing nip area F in the sheet conveyance direction (the direction from the right to the left in FIG. 2), the fixing introduction guide 23 which guides the sheet to the fixing nip area F is provided. On the downstream side of the fixing nip area F, the sheet detection sensor 24 which detects the passage of the sheet is disposed. For example, the sheet detection sensor 24 has an actuator that projects on the sheet conveyance path and is turned owing to the passage of sheet, and a PI (a photo interrupter) sensor that is turned on or off by the turning of the actuator.

The separation plate 25 which separates the sheet from the fixing roller 21 is disposed on the downstream side of the fixing nip area F in the rotational direction of the fixing roller 21 (the clockwise direction). The separation plate 25 is a plate-like member extending in the axial direction of the fixing roller 21, and separates the sheet after the fixing process from the surface of the fixing roller 21.

A pair of space regulating members 27 are fixed to both end edges of the separation plate 25 in the width direction (the direction perpendicular to the paper surface on which FIG. 2 is drawn) of the upstream end portion (the right lower end portion in FIG. 2) of the separation plate 25 in the sheet conveyance direction. When the space regulating members 27 come into contact with both the axial end portions of the outer circumferential surface of the fixing roller 21, a space between the upstream end portions of the separation plate 25 and the surface of the fixing roller 21 is set to a predetermined space.

The sheet on which the toner image has been transferred by the transfer roller 14 (see FIG. 1) advances leftward in FIG. 2, is carried into the fixing device 15 from the upstream opening of the housing, and is guided along the fixing introduction guide 23 to the fixing nip area F of the pair of fixing rollers 20. When the sheet passes through the fixing nip area F, it is heated and pressurized at a predetermined temperature and a predetermined pressure, and the toner image on the sheet is made to a permanent image. Thereafter, the sheet is separated from the fixing roller 21 by the separation plate 25, is conveyed from the downstream opening of the housing to the outside of the fixing device 15, and is discharged by the pair of discharge rollers 17 (see FIG. 1) to the outside of the image forming apparatus 100.

The fixing temperature sensor 33 including a thermistor and the others is disposed on the upstream side of the fixing nip area F in the rotational direction of the fixing roller 21.

The fixing temperature sensor 33 is disposed so as to face the axial center portion of the fixing roller 21, and detects a surface temperature of the fixing roller in a non-contact manner.

A thermostat 35 is disposed on the downstream side of the fixing nip area F in the rotational direction of the fixing roller 21. The thermostat 35 is disposed so as to face the axial center portion of the fixing roller 21, and blocks the supply of power to the heater 26 when it becomes a predetermined temperature or higher.

The detection result of the fixing temperature sensor 33 is transmitted to a controller 90 (see FIG. 3), and the fixing temperature is controlled by switching on or off the current flowing through the heater 26. Further, based on the detection result of the fixing temperature sensor 33, a performing condition of a cooling mode of the image forming apparatus 100 is changed as described later.

Figure 3:
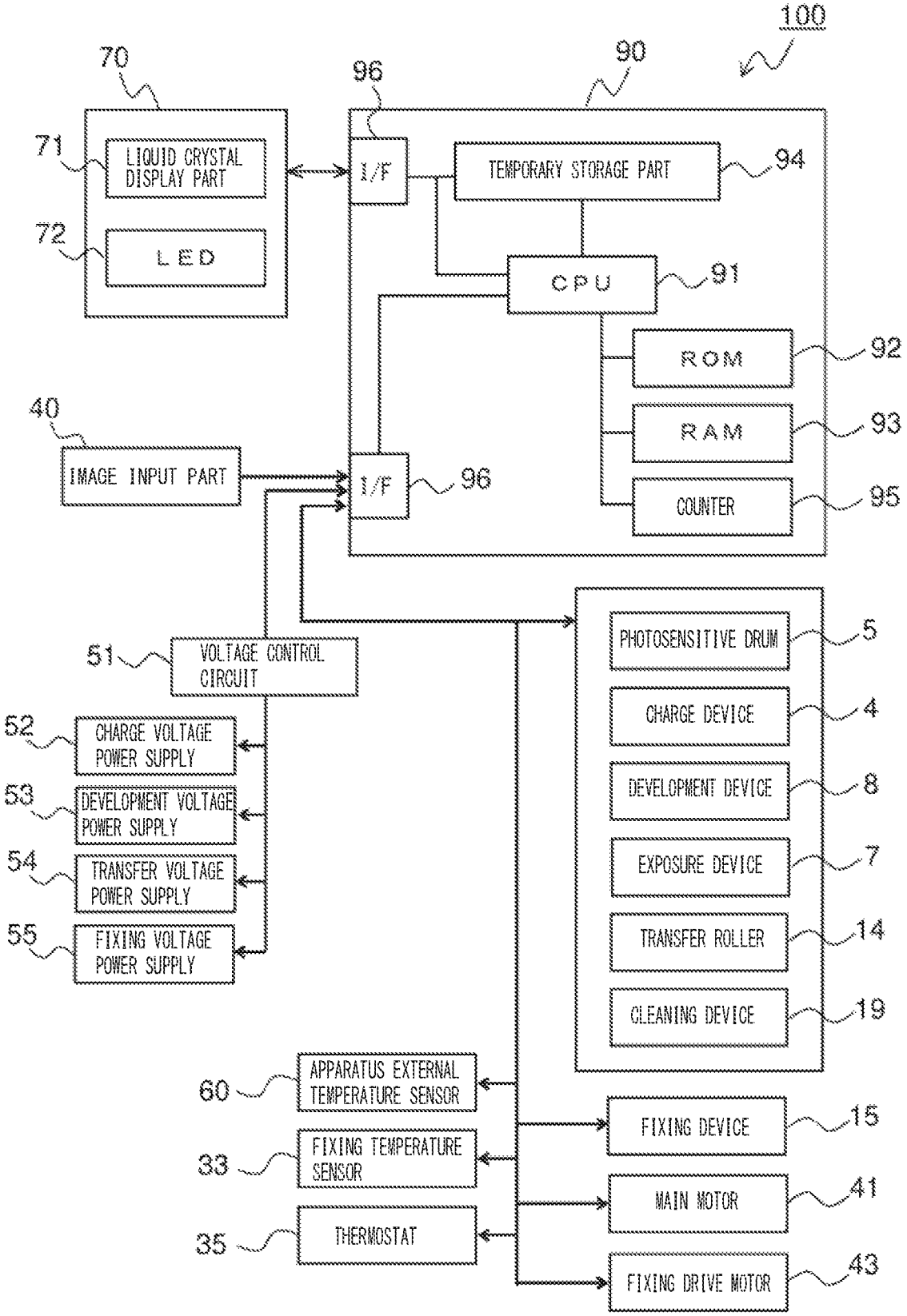
FIG. 3 is a block diagram showing an example of a control system of the image forming apparatus 100.

FIG. 3 is a block diagram showing a control system of the image forming apparatus 100. On using the image forming apparatus 100, because each part of the apparatus is controlled variously, the control system of the entire of the image forming apparatus 100 becomes complicated. Then, in the following description, a part of the control system that is necessary for the performing of the present disclosure will be mainly described. The description of the parts already described will be omitted.

An image input part 40 is a receiving unit which receives the image data transmitted from the personal computer or the like to the image forming apparatus 100. The image signal input from the image input part 40 is converted into a digital signal, and then sent to a temporary storage unit 94. A main motor 41 drives the photosensitive drum 5 to rotate it. The fixing drive motor 43 drives the fixing roller 21 of the fixing device 15 to rotate it.

A voltage control circuit 51 is connected to a charge voltage power supply 52, a development voltage power supply 53, a transfer voltage power supply 54, and a fixing voltage power supply 55, and operates these power supplies by an output signal from the controller 90. Based on the control signal from the voltage control circuit 51, the charge voltage power supply 52 supplies a predetermined voltage on the charge roller of the charge 4, the development voltage power supply 53 supplied a predetermined voltage on the development roller and the toner supply roller of the development device 8, the transfer voltage supply device 54 supplies a predetermined voltage on the transfer roller 14, and the fixing voltage power supply 55 supplies a predetermined voltage on the heater 26 of the fixing roller 21.

An apparatus external temperature sensor 60 detects a temperature of an outside of the image forming apparatus 100, and is installed at an area where is hardly affected by a heat generating part, for example, an area near an intake duct (not shown) on the side of the sheet feeding cassette 10 shown in FIG. 1.

An operation part 70 is provided with a liquid crystal display unit 71 and LEDs 72 indicating various states, and displays the state of the image forming apparatus 100, the image forming state, and the number of printed sheets. Various settings of the image forming apparatus 100 are performed from a printer driver of the personal computer.

The controller 90 includes at least a CPU (Central Processing Unit) 91 as a central processing unit, a ROM (Read Only Memory) 92 as a read-only storage unit, a RAM (Random Access Memory) 93 as a read-write storage unit, a temporary storage unit 94 for temporarily storing the image data and the like, a counter 95 (an example of a printed sheet number counting part), and a plurality of (here, two) I/Fs (interfaces) 96 for transmitting the control signal to each device in the image forming apparatus 100 and receiving an input signal from the operation part 70.

The ROM 92 stores control programs of the image forming apparatus 100 and data, such as numerical values required for control, that are not changed during use of the image forming apparatus 100. The RAM 93 stores necessary data generated during the control of the image forming apparatus 100 and data temporarily necessary for the control of the image forming apparatus 100.

A temporary storage unit 94 temporarily stores an image signal input from the image input part 40 and converted into the digital signal. The counter 95 accumulates and counts the number of printed sheets.

As described above, when the apparatus internal temperature of the image forming apparatus 100 is increased due to the heat radiation from the fixing device 15 during continuous printing, the development ability of the developer in the development device 8 is lowered, and there is a possibility that image defects occur. Further, there is a possibility that the toner in the development device 8 and the waste toner in the cleaning device 19 are aggregated to cause defective conveyance of the toner.

Therefore, the image forming apparatus 100 of the embodiment is configured to be capable of performing a cooling mode in which an upper limit number of sheets that can be continuously printed at a standard speed and a productivity (a number of printed sheet per unit time) is decreased gradually to suppress an increase of a temperature of the inside of the image forming apparatus 100 (the apparatus internal temperature) when the number of continuously printed sheets exceeds an upper limit number. Hereinafter, the setting and controlling of the cooling mode in the image forming apparatus 100 of the present embodiment will be described in detail.

Figure 4:
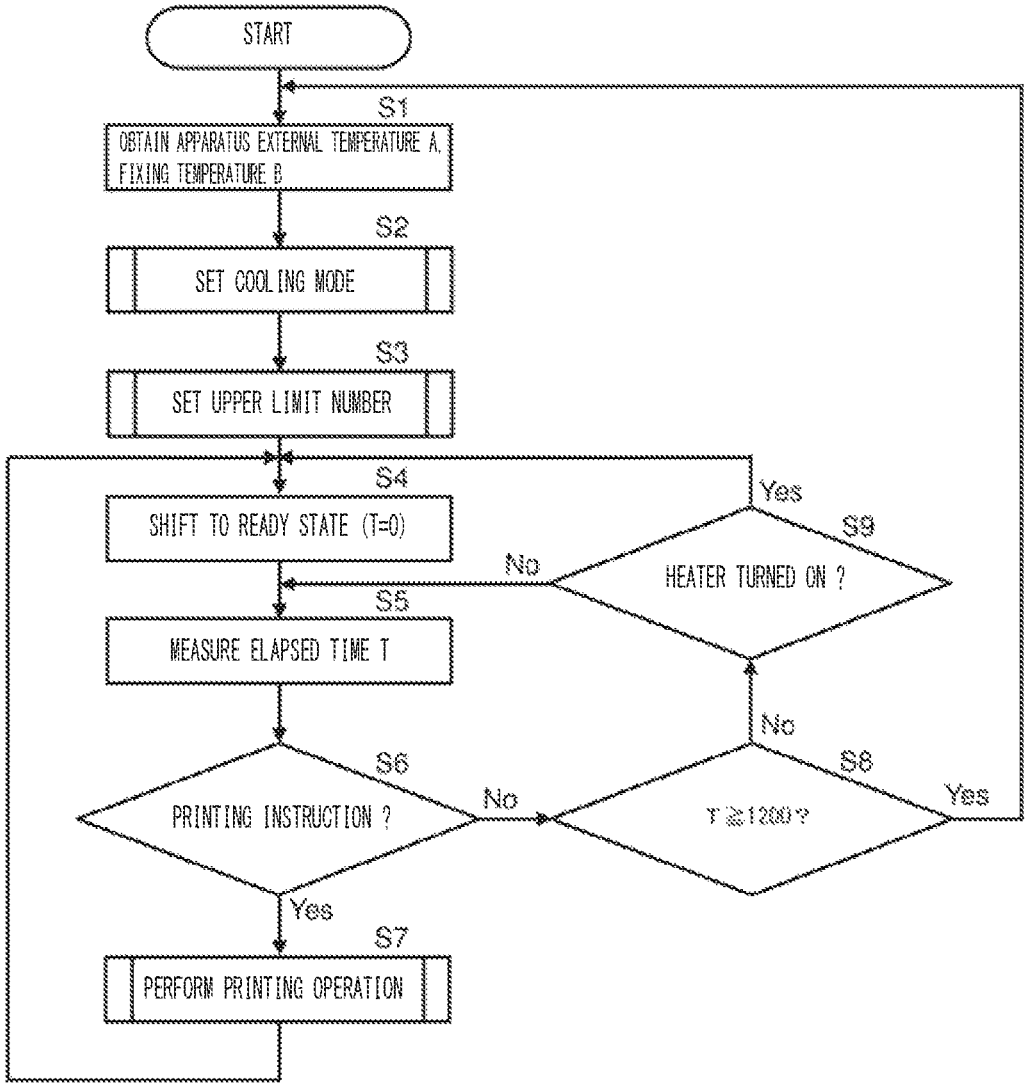
FIG. 4 is a flowchart showing an example of a cooling mode setting change control in the image forming apparatus 100 of the embodiment.

FIG. 4 is a flowchart showing an example of a cooling mode setting change control in the image forming apparatus 100 of the present embodiment. With reference to FIG. 3 to FIG. 3 as needed and FIG. 5 and FIG. 6, described below, the setting procedure of the cooling mode will be described along the steps in FIG. 4.

When the image forming apparatus 100 is powered on, the controller 90 obtains an apparatus external temperature A detected by the apparatus external temperature sensor 60 and a fixing temperature B detected by the fixing temperature sensor 33 (step S1). Next, the controller 90 performs a setting of the cooling mode based on the obtained apparatus external temperature A (step S2).

Figure 5:
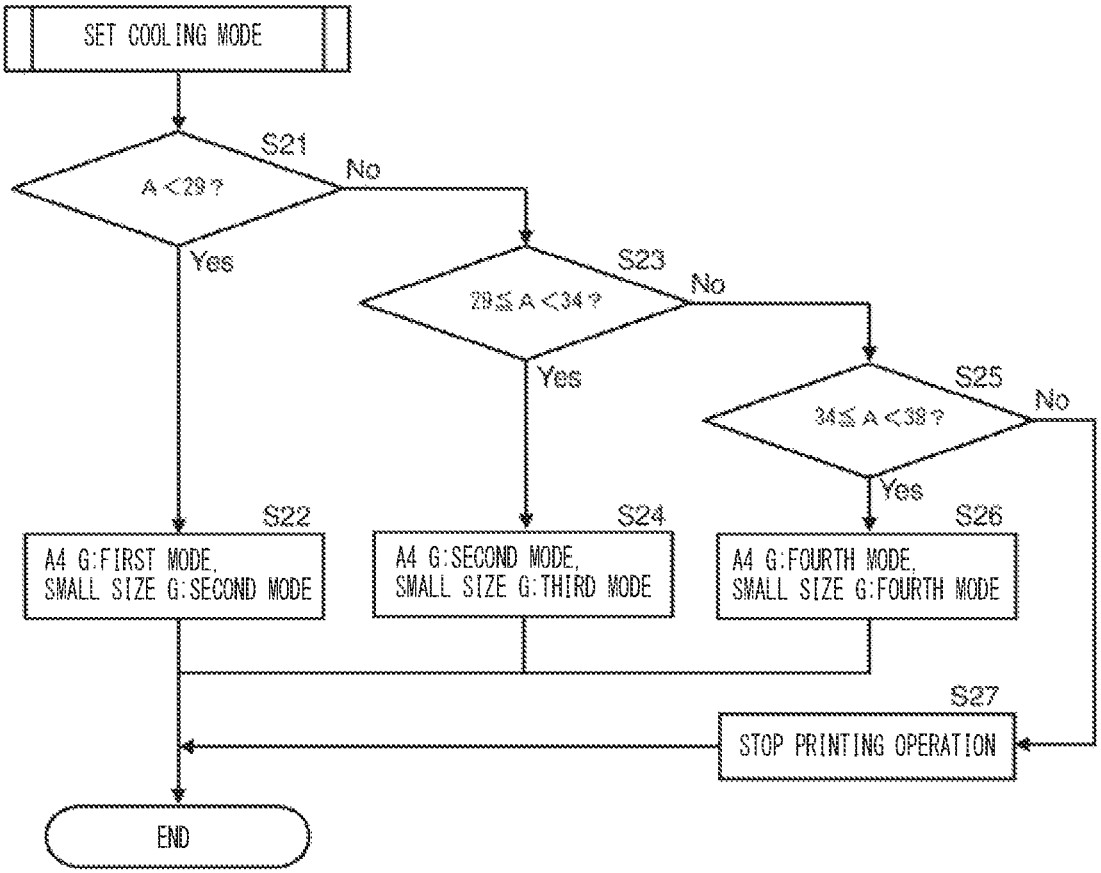
FIG. 5 is a flowchart showing an example of a setting procedure of the cooling mode in FIG. 4.

FIG. 5 is a flowchart showing an example of the cooling mode setting procedure in FIG. 4. The controller 90 determines whether the apparatus external temperature A is less than 29° C. (step S21). When A<29 (Yes in step S21), the cooling mode is set to a first mode when a size of the sheet is contained in a A4 group, and the cooling mode is set to a second mode when a size of the sheet is contained in a small size group (step S22). Specifically, in the first mode, a linear speed (hereinafter, called a process linear speed) of the conveyance roller including the photosensitive drum 5, the pair of fixing rollers 20, the pair of registration rollers 13 and the pair of discharge rollers 17 is decreased to ¾ of a reference speed (a full speed mode). In the second mode, the process linear speed is decreased to ¾ of the reference speed and the printing operation is stopped for 20 seconds every two sheets printing.

A reason to change the cooling mode depending on a size of the sheet is because when the size in the width direction is a predetermined value or smaller, a temperature in a non-sheet passing area of the fixing roller 21 is increased owing to the continuous sheet passing, and the apparatus internal temperature is easily increased. That is, when the sheet size is small, the cooling mode having a higher cooling effect is set. Here, "A4 group" means an A4R size, a LTR size, a LGL size, a A5E size, a 16K size, and a Folio size. The "small size group" means a B5R size, a A5R size, and Executive size. The sheet size may be detected by a sheet size detection sensor (not shown) provided in the image forming apparatus 100, or input from the operation part 70 or he personal computer.

When the apparatus external temperature A is 29° C. or higher (No in step S21), the controller 90 determines whether the apparatus external temperature A is less than 34° C. (step S23). When 29≤A<34 (Yes in step S23), the cooling mode is set to the second mode when the sheet size is contained in the A4 group, and the cooling mode is set to a third mode when the sheet size is contained in the small size group (step S22). Specifically, in the third mode, the process linear speed is decreased to ¾ of the reference speed, and the printing operation is stopped for 25 seconds for one sheet printing.

When the apparatus external temperature A is 34° C. or higher (No in step S23), the controller 90 determines whether the apparatus external temperature A is less than 38° C. (step S25). If 34≤A<38 (Yes in step S23), the cooling mode is set to a fourth mode when the sheet size in contained in the A4 side group and the small side group (step S26). Specifically, in the fourth mode, the process linear speed is decreased to ¾ of the reference speed, and the printing operation is stopped for 120 seconds for one sheet printing.

When the apparatus external temperature A is 38° C. or higher (No in step S25), the controller 90 stops the printing operation (step S27). Table 1 shows the cooling modes set according to the apparatus external temperature A and the sheet size.

TABLE 1

| APPARATUS | COOLING MODE | |
|---|---|---|
| EXTERNAL TEMPERATURE A(° C.) | A4 GROUP | SMALL SIZE GROUP |
| A < 29 | FIRST MODE | FIRST MODE |
| 29 ≤ A < 34 | SECOND MODE | THIRD MODE |
| 34 ≤ A < 38 | FOURTH MODE | FOURTH MODE |
| A > 38 | PRINTING OPERATION STOPPED | PRINTING OPERATION STOPPED |

Figure 6:
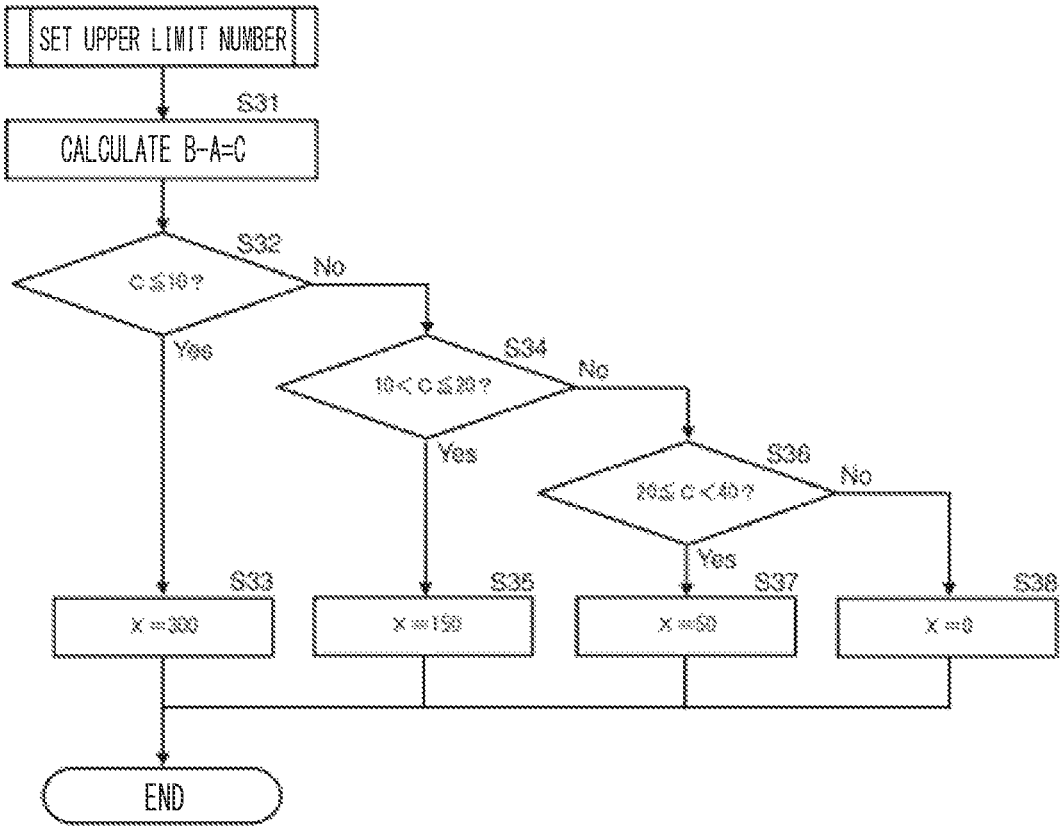
FIG. 6 is a flowchart showing an example of a setting procedure of an upper limit number of a sheet that can be printed at a standard speed until the cooling mode in FIG. 4 is performed.

Return to FIG. 4, the controller 90 sets an upper limit number of sheets that can be printed at the reference speed, based on the obtained apparatus external temperature A and the fixing temperature B (step S3). FIG. 6 is a flowchart showing an example of the procedure for setting the upper limit number of sheets that can be printed at the reference speed until the cooling mode is performed, in FIG. 4. The controller 90 calculates a temperature difference C between the fixing temperature B and the apparatus external temperature A (step S31).

Next, the controller 90 determines whether the temperature difference C is 10° C. or smaller (step S32). If C≤10 (Yes in step S32), the controller 90 sets the upper limit number X to 300 (step S33). If the temperature difference C exceeds 10° C. (No in step S32), the controller 90 determines whether the temperature difference C is 20° C. or smaller (step S34). If 10<C≤20 (Yes in step S34), the controller 90 sets the upper limit number X to 150 (step S33).

If the temperature difference C exceeds 20° C. (No in step S34), the controller 90 determines whether the temperature difference C is 40° C. or smaller (step S36). If 20<C≤40 (Yes in step S36), the controller 90 sets the upper limit number X to 50 (step S37). When the temperature difference C exceeds 40° C. (No in step S36), the controller 90 sets the upper limit number X to 0 (step S38).

Similarly to the cooling mode, the upper limit number X is also changed depending on the sheet size. Specifically, the upper limit number X of the small size group is ½ of the upper limit number of the A4 group. Table 2 shows the upper limit number of sheets set depending on the temperature difference C and the sheet size.

TABLE 2

| | UPPER LIMIT NUMBER | |
|---|---|---|
| TEMPERATURE DIFFERENCE C. (deg) | A4 GROUP | SMALL SIZE GROUP |
| C ≤ 10 | 300 | 150 |
| 10 < C ≤ 20 | 150 | 75 |
| 20 < C ≤ 40 | 50 | 25 |
| C > 40 | 0 | 0 |

Returning to FIG. 4, the controller 90 transfers the state of the image forming apparatus 100 to a ready state (step S4), and counts an elapsed time T (seconds) from a time when the heater 26 is turned off (step S5). Then, the controller 90 determines whether the printing instruction is input (step S6). If the printing instruction is input, the printing operation is performed (step S7). Thereafter, the process returns to step S4, the elapsed time T is reset (T=0), and then the state of the image forming apparatus 100 is shifted to next ready state. The printing operation including a shift of the cooling mode will be described later.

If the printing instruction is not input in step S6 (No in step S6), the controller 90 determines whether the elapsed time T is equal to 1200 seconds (=20 minutes) or longer (step S7). When T<1200 (No in step S7), it is determined whether the heater 26 is supplied with a power (step S8). When the heater 26 is not supplied with a power (No in step S8), the process returns to step S5, and the measurement of the elapsed time T and the standby state of the printing instruction are continued. When the heater 26 is supplied with a power (Yes in step S8), the process returns to step S4, the elapsed time T is reset and the state of the image forming apparatus 100 is shifted to next ready state.

If T≥1200 in step S7 (Yes in step S7), the process returns to step S1, the apparatus external temperature A and the fixing temperature B are obtained again, the cooling mode and the upper limit number of sheets are set again, and then the same control as described above is performed (steps S1 to S6).

The purpose of calculating the temperature difference C by obtaining the apparatus external temperature A and the fixing temperature B again every 20 minutes in step S7 is to monitor the temperature decrease around the fixing device 15 after the heater 26 is powered off. This is because, if the periphery of the fixing device 15 is sufficiently cooled, the temperature difference C approaches 0, and the upper limit number X of sheet that can be continuously printed at the reference speed can be relaxed.

Figure 7:
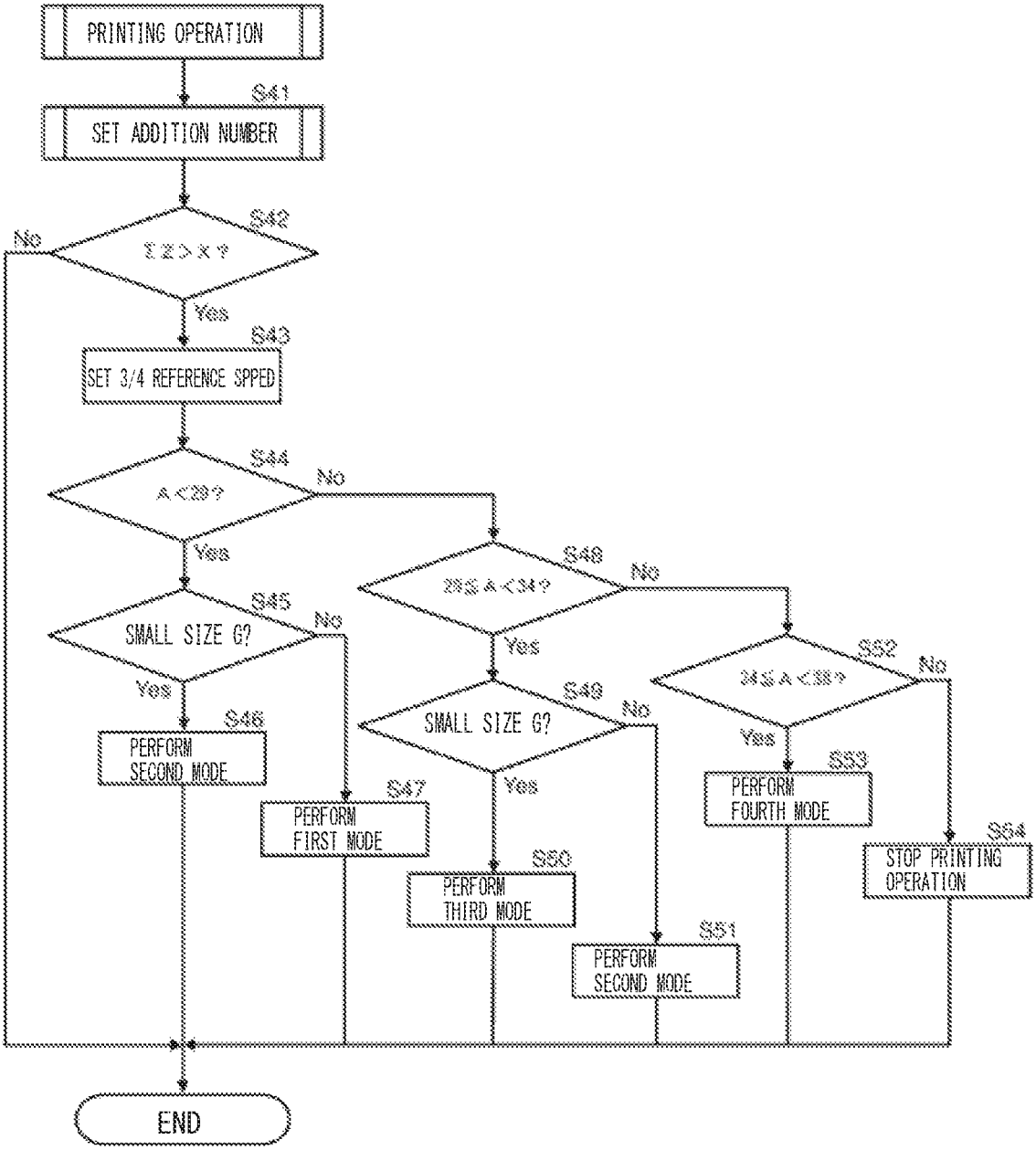
FIG. 7 is a flowchart showing an example of a control for determining the cooling mode during an image forming operation.
Figure 8:
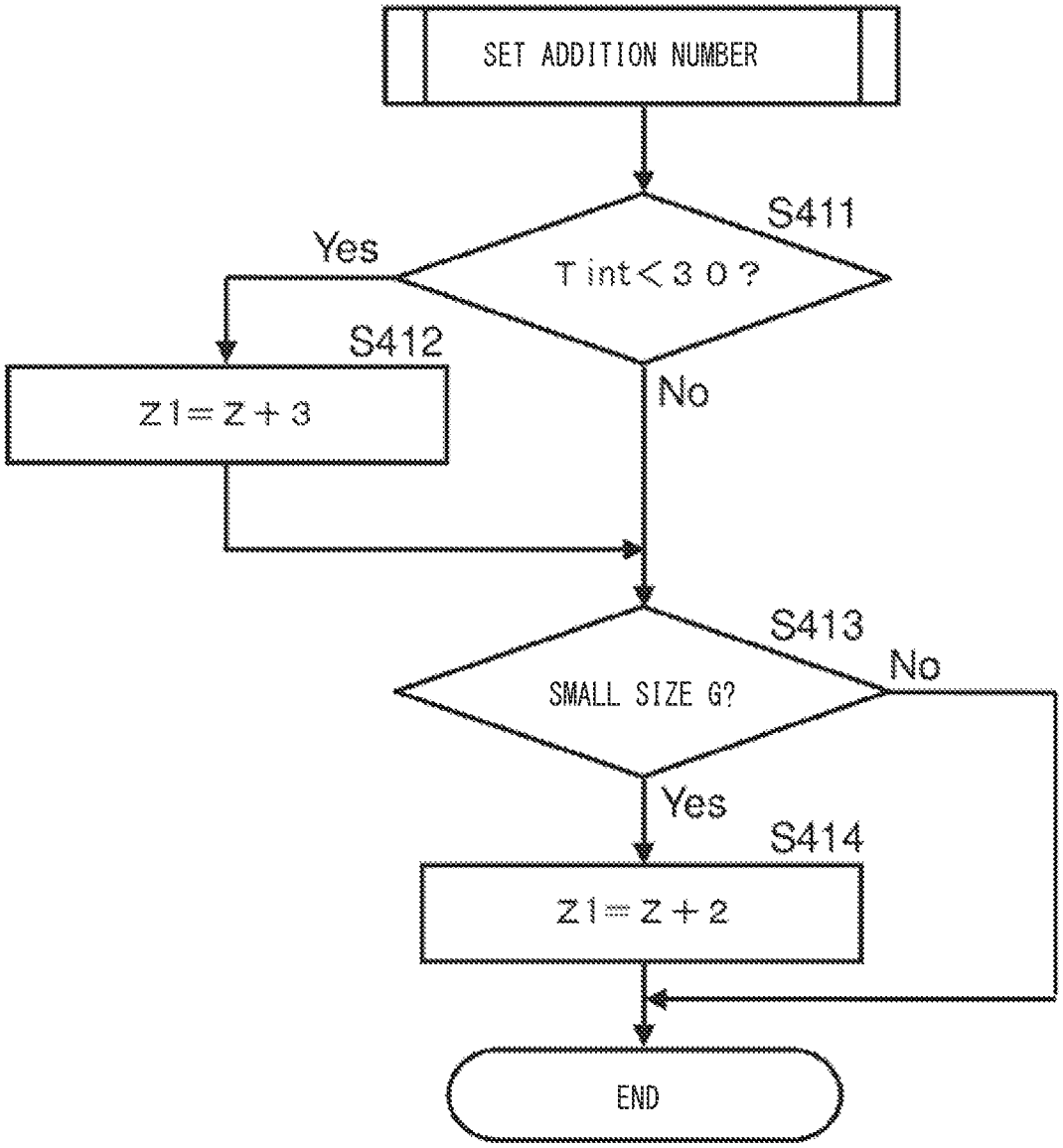
FIG. 8 is a flowchart showing an example of a setting procedure for addition of the number of printed sheets in FIG. 7.
Figure 9:
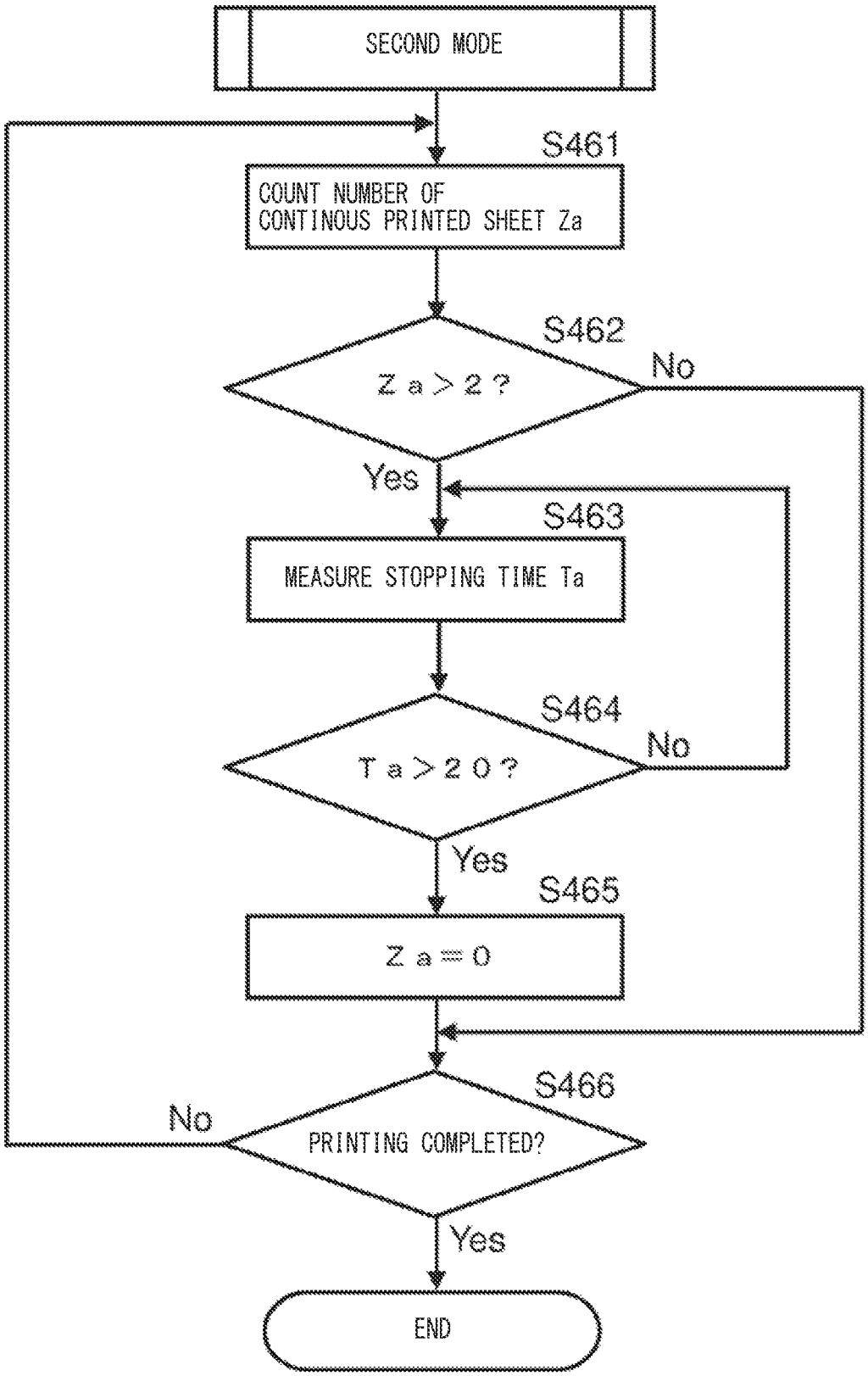
FIG. 9 is a flowchart showing a performing procedure of a second mode which is one mode of the cooling mode.

FIG. 7 is a flowchart showing an example of a control for determining the cooling mode during the printing operation. With reference to FIG. 8 and FIG. 9 to be described later, a performing procedure of the printing operation including the cooling mode will be described along the steps of FIG. 7. When the printing instruction is input (step S6 in FIG. 4), the controller 90 performs a printed sheet number addition setting, based on the elapsed time (a time between JOBs) from a time when the last printing is completed and the sheet size (step S41).

FIG. 8 is a flowchart showing an example of the procedure of the printed sheet number addition setting in FIG. 7. The controller 90 determines whether an elapsed time Tint (second) from a time when the last printing is completed is less than 30 seconds (step S411). If Tint<30 (Yes in step S411), the number of printed sheets is counted by adding three virtual printed sheets per one actual printed sheet (addition of three printed sheets). That is, when the actual number of printed sheets per one JOB is Z and the number of printed sheets after the addition process is Z1, Z1=Z+3 (step S412).

If Tint≥30 in step 411 (No in step S411), the controller 90 determines whether the sheet size is contained in the small size group (step S413). If the sheet size is contained in the small size group (Yes in step S413), the number of printed sheets is counted by adding two vertical printed sheets per one actual printed sheet (addition of one printed sheet). That is, when the actual number of printed sheets per one JOB (the actual number of printed sheets) is Z and the number of printed sheets after the addition process (the addition number of printed sheets) is Z1, Z1=Z+2 (step S414).

When the sheet size is not contained in the small size group (No in step S413), the process is completed without performing the printed sheet number addition process. The relationship of the number of printed sheets Z, the number of printing N and the upper limit number of printed sheets X per one JOB in cases where the printed sheet number addition process is not performed, three printed sheets are added and one printed sheet is added is shown in Tables 3 to 5.

TABLE 3

| NUMBER OF PRINTED SHEETS Z | NUMBER OF PRINTINGS N | UPPER LIMIT NUMBER OF PRINTED SHEETS X |
|---|---|---|
| 1 | 300 | 300 |
| 2 | 150 | 300 |
| 3 | 100 | 300 |
| 4 | 75 | 300 |
| 5 | 60 | 300 |

TABLE 4

| NUMBER OF PRINTED SHEETS Z | NUMBER OF PRINTINGS N | UPPER LIMIT NUMBER OF PRINTED SHEETS X |
|---|---|---|
| 1 | 75 | 75 |
| 2 | 60 | 120 |
| 3 | 50 | 150 |
| 4 | 43 | 112 |
| 5 | 38 | 190 |

TABLE 5

| NUMBER OF PRINTED SHEETS Z | NUMBER OF PRINTINGS N | UPPER LIMIT NUMBER OF PRINTED SHEETS X |
|---|---|---|
| 1 | 100 | 100 |
| 2 | 75 | 150 |
| 3 | 60 | 180 |
| 4 | 50 | 200 |
| 5 | 43 | 215 |

Table 3 shows the relationship of the number of printed sheets Z, the number of printings N, and the upper limit number of printed sheets X per one JOB in the case where the printed sheet number addition process is not performed, and corresponds to a case where the elapsed time Tint from a time when the last printing is completed is more than 30 seconds and the sheet size is contained in the A4 group. In this case, the cumulative number of printed sheets is the actual number of printed sheets Z x the number of printings N. Therefore, the upper limit number of printed sheets is set to 300 regardless of the actual number of printed sheets Z.

Table 4 shows the relationship of the number of printed sheets Z, the number of printings N, and the upper limit number of printed sheets X per one JOB in the case where three printed sheets are added, and corresponds to a case where the elapsed time Tint from a time when the last printing is completed is less than 30 seconds. In this case, the calculated cumulative number of printed sheets is the addition number of printed sheets Z1 (the actual number of printed sheets Z+3)×the number of printings N, but the actual number of printed sheets is Z×N.

For example, in a case where the actual number of printed sheets Z per one JOB is one, since the addition number of printed sheets Z1 is 1+3=4, the number of printing N (X/Z1)=300/4=75, and the cumulative actual number of printed sheets (a subtraction number of printed sheet) is Z×N=1×75=75. In a case where the number of printed sheets Z per one JOB is three, since the number of printed sheets Z1 after the addition process is 3+3=6, the number of printing N is 300/6=50, and the subtraction number of printed sheets is Z×N=3×50=150.

Table 5 shows the relationship of the number of printed sheets Z, the number of printings N, and the upper limit number of printed sheets X per one JOB in the case where two printed sheets are added, and corresponds to a case where the sheet size is contained in the small size group. In this case, the calculated cumulative number of printed sheets is the addition number of printed sheets Z1 (the actual number of printed sheets Z+2)×the number of printings N, but the actual number of printed sheets is Z×N.

For example, in a case where the actual number of printed sheets Z per one JOB is one, since the addition number of printed sheets Z1 is 1+2=3, the number of printings N (X/Z1) is 300/3=100, and the subtraction number of printed sheets is Z×N=1×100=100. In a case where the actual number of printed sheets Z per one JOB is three, since the addition number of printed sheets Z1 is 3+2=5, the number N of printings is 300/5=60, and the subtraction number of printed sheets is Z×N=3×60=180.

When the elapsed time Tint is less than 30 seconds and the sheet size is contained in the small size group, the subtraction number of printed sheets calculated in the above manner is set to the upper limit number of printed sheets X, so that the upper limit number of the printed sheets X varies depending on the actual number of printed sheets Z per one JOB.

Returning to FIG. 7, the controller 90 determines whether the cumulative number of printed sheets ΣZ exceeds the upper limit number of printed sheets X (step S42). If ΣZ≤X (No in step S42), the printing operation is performed while maintaining the process linear speed at the reference speed, and the process is completed. If ΣZ>X (Yes in step S42), the process is shifted to the cooling mode. The controller 90 transmits the control signals to the main motor 41 and the fixing drive motor 43, and changes the process linear speed to ¾ speed (¾ of the reference speed) (step S43).

Next, the controller 90 determines whether the apparatus external temperature A is less than 29° C. (step S44). If A<29° C. (Yes in step S43), the controller 90 determines whether the sheet size is contained in the small size group (step S45). If the sheet size is contained in the small size group (Yes in step S45), the cooling mode is performed with the second mode where the printing operation is stopped for 20 seconds every two sheets printing (step S46). If the sheet size is contained in the A4 group (No in step S45), the cooling mode is performed with the first mode where the continuous printing is performed at ¾ speed (step S47).

FIG. 9 is a flowchart showing a performing procedure of the second mode as one pattern of the cooling mode. When the second mode is performed, the controller 90 counts the number of continuous printed sheets Za during the second mode (step S461). Then, the controller 90 determines whether the number of continuous printed sheets Za exceeds two (step S462). If Za>2 (Za=3) (Yes in step S462), the printing operation is stopped, and the stopping time Ta is measured (step S463). Next, the controller 90 determines whether the stopping time Ta exceeds 20 seconds (step S464), if the stopping time Ta exceeds 20 seconds (Yes in step S464), it resets Za (Za=0) (step S465), and then determines whether the printing operation is completed (step S466).

On the other hand, when Za≤2 (No in step S462), it is determined whether the printing operation is completed, without stopping the printing operation (step S466). If the printing operation is completed (Yes in step 466), the second mode is completed. If the printing operation continues (No in step S466), the process returns to step S461, and the same processes are repeated (steps S461 to S466). In the third mode and the fourth mode described later, the same processes as the second mode are performed except that the upper limit number of the continuously printed sheet Za and the stopping time Ta are different.

Returning to FIG. 7, when A≥29 in step S44 (No in step S44), it is determined whether the apparatus external temperature A is less than 34° C. (step S48). If 29≤A<34 (Yes in step S48), it is determined whether the sheet size is contained in the small size group (step S49). If the sheet size is contained in the small size group (Yes in step S49), the cooling mode is performed with the third mode where the printing operation is stopped for 25 seconds every one sheet printing (step S50). If the sheet size is contained in the A4 group (No in step S49), the cooling mode is performed with the second mode where the printing operation is stopped for 20 seconds every two sheets printing (step S51).

When A≥34 in step S48 (No in step S48), it is determined whether the apparatus external temperature A is lower than 38° C. (step S52). If 34≤A<38 (Yes in step S52), the cooling mode is performed with the fourth mode where the printing operation is stopped for 120 seconds every one sheet printing regardless of the sheet size (step S53). If A≥38 in step S52 (No in step S52), the printing operation is stopped (step S54).

According to the above control example, the upper limit number of continuous printed sheets at the reference speed until the process is shifted to the cooling mode is set depending on the temperature difference C between the fixing temperature B and the apparatus external temperature A, so that when the fixing temperature B is sufficiently decreased, it becomes possible to relax the upper limit number X and to suitably change the process efficiency (the productivity) of the image forming apparatus 100. Further, the apparatus external temperature A is detected by the apparatus external temperature sensor 60 and the fixing temperature B is detected by the fixing temperature sensor 33, and the inside of the image forming apparatus 100 is sufficiently cooled by suitable shifting to the cooling mode. Therefore, it is not required to provide a temperature sensor for detecting the temperature of the inside of the image forming apparatus 100 and a cooling mechanism such as a cooling fan, and it becomes possible to make the image forming apparatus 100 small and to decrease the cost of the image forming apparatus 100.

Further, by changing the cooling mode to the first mode to the fourth mode based on the apparatus external temperature A and the sheet size, it becomes possible to maintain the productivity as large as possible while suppressing the increase of the apparatus internal temperature of the image forming apparatus 100. Further, when the apparatus external temperature is more than the predetermined temperature (38° C.), the printing operation is stopped, so that it is possible to prevent the operation failure and the image defect owing to the increase of the apparatus external temperature. Here, the cooling mode is changed to four stages, but may be changed to three stages or five stages or more.

Further, by performing the printed sheet number addition process in which the number of printed sheet is counted in such a manner that the vertical number of printed sheets is added to the actual number of printed sheets based on the elapsed time Tint from a time when the last printing is completed and the sheet size, the upper limit number of printed sheets until the process is shifted to the cooling mode can be decreased in a case where the apparatus internal temperature tends to increase, for example, a case where the elapsed time Tint is short or the sheet size is small.

The present disclosure is not limited to the above embodiments, and various modifications can be made without departing from the spirit of the present disclosure. For example, in the above embodiment, the heat roller fixing type fixing device 15 has been described by way of example, in which the toner is fixed by passing the sheet carrying the unfixed toner image through the fixing nip area F formed by the fixing roller 21 and the pressing roller 22, but it is also applicable to a belt fixing type fixing device which is provided with an endless fixing belt instead of the fixing roller 21 and fixes the toner by passing the sheet carrying the unfixed toner image into a fixing nip area formed by the fixing belt and a pressure member pressed on the fixing belt.

Further, in the above embodiment, the cooling mode is performed by decreasing the process linear speed from the reference speed to ¾ of the reference speed in addition to the intermittent printing operation in which the printing operation is stopped for a predetermined time every predetermined number of printings, but the cooling mode may be performed only by the decrease of the process linear speed or the intermittent printing operation.

Further, the present disclosure is applicable not limited to the monochrome printer shown in FIG. 1, but to other image forming apparatuses provided with the fixing device, such as a color printer, a monochrome and color copying machine, a digital multifunctional peripheral, or a facsimile machine.

The present disclosure is applicable to a fixing device including a fixing member such as the fixing roller and the pressing roller. By utilizing the present disclosure, it is possible to provide an image forming apparatus capable of suppressing an operation failure and an image failure due to an increase in temperature in the apparatus and maintaining a constant productivity.

The invention claimed is:

1. An image forming apparatus comprising:

an image forming part which forms a toner image on a recording medium;

a fixing device disposed on a downstream side of the image forming part in a conveyance direction of the recording medium, and including a fixing member including a heated rotating body heated by a heating device and a pressing member coming into contact with the heated rotating body to form a fixing nip area, the fixing device heating and pressurizing the recording medium passing through the fixing nip area to fix the toner image on the recording medium;

a fixing temperature sensor which detects a fixing temperature that is a surface temperature of the heated rotating body;

a drive device which drives a conveyance member for conveying the recording medium, the conveyance member including the fixing member;

a printed sheet number counting part which accumulates and counts a number of printed sheets:

a fixing voltage power source which applies a voltage to the heating device; and a controller which controls the drive device and the fixing voltage power source, wherein an apparatus external temperature sensor which detects an apparatus external temperature that is a temperature of an outside of the image forming apparatus is further provided, the controller can perform a cooling mode in which, when a number of continuous printed sheets at a reference speed exceeds an upper limit number, a number of printed sheets per unit time is gradually decreased to suppress an increase of an apparatus internal temperature that is a temperature of an inside of the image forming apparatus, the controller sets the upper limit number based on a temperature difference between the fixing temperature detected by the fixing temperature sensor and the apparatus external temperature detected by the apparatus external temperature sensor, and the controller resets the upper limit number based on the temperature difference between the fixing temperature and the apparatus external temperature when a state where a voltage is not applied to the heating device continues for a fixed time from a time when the last printing operation is completed.

2. The image forming apparatus according to claim 1, wherein, the cooling mode has a plurality of modes in which the number of printed sheets per unit time is different, and the controller selects the mode in which the number of printed sheets per unit time is smaller as the apparatus external temperature is higher.

3. The image forming apparatus according to claim 2, wherein the controller selects the mode in which the number of printed sheets per unit time is smaller as a size of the recording medium is smaller.

4. The image forming apparatus according to claim 1, wherein when the number of continuous printed sheets at the reference speed exceeds the upper limit number, the controller performs the cooling mode with decreasing a conveyance speed of the recording medium from the reference speed.

5. The image forming apparatus according to claim 1, wherein the controller obtains the apparatus external temperature and the fixing temperature again at predetermined time intervals to calculate the temperature difference.

6. The image forming apparatus according to claim 1, wherein the controller sets the upper limit number to be smaller as the temperature difference is larger.

7. An image forming apparatus comprising:

an image forming part which forms a toner image on a recording medium;

a fixing device disposed on a downstream side of the image forming part in a conveyance direction of the recording medium, and including a fixing member including a heated rotating body heated by a heating device and a pressing member coming into contact with the heated rotating body to form a fixing nip area, the fixing device heating and pressurizing the recording medium passing through the fixing nip area to fix the toner image on the recording medium;

a fixing temperature sensor which detects a fixing temperature that is a surface temperature of the heated rotating body;

a drive device which drives a conveyance member for conveying the recording medium, the conveyance member including the fixing member;

a printed sheet number counting part which accumulates and counts a number of printed sheets;

a fixing voltage power source which applies a voltage to the heating device; and a controller which controls the drive device and the fixing voltage power source, wherein an apparatus external temperature sensor which detects an apparatus external temperature that is a temperature of an outside of the image forming apparatus is further provided, the controller can perform a cooling mode in which, when a number of continuous printed sheets at a reference speed exceeds an upper limit number, a number of printed sheets per unit time is gradually decreased to suppress an increase of an apparatus internal temperature that is a temperature of an inside of the image forming apparatus, the controller sets the upper limit number based on a temperature difference between the fixing temperature detected by the fixing temperature sensor and the apparatus external temperature detected by the apparatus external temperature sensor, and when the number of continuous printed sheets at the reference speed exceeds the upper limit number, the controller performs the cooling mode by an intermittent printing operation in which the printing operation is stopped for a predetermined time after the printing of a predetermined number of sheets.

8. An image forming apparatus comprising:

an image forming part which forms a toner image on a recording medium;

a fixing device disposed on a downstream side of the image forming part in a conveyance direction of the recording medium, and including a fixing member including a heated rotating body heated by a heating device and a pressing member coming into contact with the heated rotating body to form a fixing nip area, the fixing device heating and pressurizing the recording medium passing through the fixing nip area to fix the toner image on the recording medium;

a fixing temperature sensor which detects a fixing temperature that is a surface temperature of the heated rotating body;

a drive device which drives a conveyance member for conveying the recording medium, the conveyance member including the fixing member;

a printed sheet number counting part which accumulates and counts a number of printed sheets;

a fixing voltage power source which applies a voltage to the heating device; and a controller which controls the drive device and the fixing voltage power source, wherein an apparatus external temperature sensor which detects an apparatus external temperature that is a temperature of an outside of the image forming apparatus is further provided, the controller can perform a cooling mode in which, when a number of continuous printed sheets at a reference speed exceeds an upper limit number, a number of printed sheets per unit time is gradually decreased to suppress an increase of an apparatus internal temperature that is a temperature of an inside of the image forming apparatus, the controller sets the upper limit number based on a temperature difference between the fixing temperature detected by the fixing temperature sensor and the apparatus external temperature detected by the apparatus external temperature sensor, and when an elapsed time from a time when the last printing operation is completed is shorter than a predetermined time, or when a size of the recording medium is smaller than a predetermined size, the controller resets the upper limit number by subtracting from the upper limit number set based on the temperature difference between the fixing temperature and the apparatus external temperature.

9. An image forming apparatus comprising:

an image forming part which forms a toner image on a recording medium;

a fixing device disposed on a downstream side of the image forming part in a conveyance direction of the recording medium, and including a fixing member including a heated rotating body heated by a heating device and a pressing member coming into contact with the heated rotating body to form a fixing nip area, the fixing device heating and pressurizing the recording medium passing through the fixing nip area to fix the toner image on the recording medium;

a fixing temperature sensor which detects a fixing temperature that is a surface temperature of the heated rotating body;

a drive device which drives a conveyance member for conveying the recording medium, the conveyance member including the fixing member;

a printed sheet number counting part which accumulates and counts a number of printed sheets;

a fixing voltage power source which applies a voltage to the heating device; and a controller which controls the drive device and the fixing voltage power source, wherein an apparatus external temperature sensor which detects an apparatus external temperature that is a temperature of an outside of the image forming apparatus is further provided, the controller can perform a cooling mode in which, when a number of continuous printed sheets at a reference speed exceeds an upper limit number, a number of printed sheets per unit time is gradually decreased to suppress an increase of an apparatus internal temperature that is a temperature of an inside of the image forming apparatus, the controller sets the upper limit number based on a temperature difference between the fixing temperature detected by the fixing temperature sensor and the apparatus external temperature detected by the apparatus external temperature sensor, the controller performs a printed sheet number addition process for counting an addition number of printed sheets in such a manner that a vertical number of printed sheets is added to an actual number of printed sheets per one printing operation, the controller calculates a number of printings by dividing the upper limit number by the addition number of printed sheets, obtains a subtraction number of printed sheets by multiplying the number of printings by the actual number of printed sheets, and resets the subtraction number of printed sheets as the upper limit number.

* * * * *